US011636836B2

(12) United States Patent
Zheng et al.

(10) Patent No.: US 11,636,836 B2
(45) Date of Patent: Apr. 25, 2023

(54) METHOD FOR PROCESSING AUDIO AND ELECTRONIC DEVICE

(71) Applicant: BEIJING DAJIA INTERNET INFORMATION TECHNOLOGY CO., LTD., Beijing (CN)

(72) Inventors: Xiguang Zheng, Beijing (CN); Chen Zhang, Beijing (CN)

(73) Assignee: BEIJING DAJIA INTERNET INFORMATION TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 17/702,416

(22) Filed: Mar. 23, 2022

(65) Prior Publication Data

US 2022/0215821 A1 Jul. 7, 2022

Related U.S. Application Data

(63) Continuation of application No. PCT/CN2021/073380, filed on Jan. 22, 2021.

(30) Foreign Application Priority Data

Jan. 22, 2020 (CN) ..... 202010074552.2

(51) Int. Cl.
*G10H 1/36* (2006.01)
*G10H 1/00* (2006.01)

(52) U.S. Cl.
CPC ..... *G10H 1/366* (2013.01); *G10H 1/0008* (2013.01); *G10H 2210/005* (2013.01);
(Continued)

(58) Field of Classification Search
CPC ..... G10H 2210/066; G10H 1/0025; G10H 1/0008; G10H 1/366; G10H 2210/091;
(Continued)

(56) References Cited

U.S. PATENT DOCUMENTS 5,502,768 A 3/1996 Shioda
6,091,824 A 7/2000 Lin et al.
(Continued)

FOREIGN PATENT DOCUMENTS

CN 101454825 A 6/2009
CN 101609667 A 12/2009
(Continued)

OTHER PUBLICATIONS

International Search Report of the International Searching Authority for State Intellectual Property Office of the People's Republic of China in PCT application No. PCT/CN2021/073380 dated Apr. 29, 2021, which is an international application corresponding to this U.S. application.

(Continued)

*Primary Examiner* — Marlon T Fletcher
(74) *Attorney, Agent, or Firm* — Kolitch Romano Dascenzo Gates LLC

(57) ABSTRACT

Provided is a method for processing audio including: acquiring an accompaniment audio signal and a voice signal of a current to-be-processed musical composition; determining a target reverberation intensity parameter value of the acquired accompaniment audio signal, wherein the target reverberation intensity parameter value is configured to indicate a rhythm speed, an accompaniment type, and a performance score of a singer of the current to-be-processed musical composition; and reverberating the acquired vocal signal based on the target reverberation intensity parameter value.

20 Claims, 8 Drawing Sheets

(52) U.S. Cl.
CPC . *G10H 2210/076* (2013.01); *G10H 2210/091* (2013.01); *G10H 2210/281* (2013.01)

(58) Field of Classification Search
CPC ..... G10H 2210/331; G10H 2210/081; G10H 2210/021; G10H 2210/076; G10H 2210/105; G10H 2210/111; G10H 2210/341; G10H 2210/005; G10H 1/40; G10H 2210/155; G10H 2210/291; G10H 1/02; G10H 1/365; G10H 2210/315; G10H 2240/325; G10H 2210/391; G10H 1/00; G10H 1/36
See application file for complete search history.

(56) References Cited

U.S. PATENT DOCUMENTS

| | | | | |
|---|---|---|---|---|
| 10,163,429 | B2 | 12/2018 | Silverstein | |
| 10,424,283 | B2 | 9/2019 | Sung et al. | |
| 2008/0232603 | A1 | 9/2008 | Soulodre | |
| 2014/0039883 | A1* | 2/2014 | Yang | G10H 1/366 704/207 |
| 2016/0358595 | A1* | 12/2016 | Sung | G11B 27/031 |
| 2017/0287457 | A1 | 10/2017 | Vorobyev | |
| 2019/0266987 | A1* | 8/2019 | Yang | G10H 1/365 |

FOREIGN PATENT DOCUMENTS

| | | | | | |
|---|---|---|---|---|---|
| CN | 103295568 | A | | 9/2013 | |
| CN | 105161081 | A | | 12/2015 | |
| CN | 105654932 | A | | 6/2016 | |
| CN | 108040497 | A | | 5/2018 | |
| CN | 108282712 | A | | 7/2018 | |
| CN | 108305603 | A | | 7/2018 | |
| CN | 108369799 | A | | 8/2018 | |
| CN | 108922506 | A | * | 11/2018 | |
| CN | 108986842 | A | | 12/2018 | |
| CN | 109741723 | A | | 5/2019 | |
| CN | 109785820 | A | | 5/2019 | |
| CN | 109785820 | A | * | 5/2019 | |
| CN | 109830244 | A | | 5/2019 | |
| CN | 109872710 | A | | 6/2019 | |
| CN | 110211556 | A | | 9/2019 | |
| CN | 110211556 | A | * | 9/2019 | |
| CN | 110688082 | A | * | 1/2020 | G06F 3/165 |
| CN | 108008930 | B | * | 6/2020 | G06F 3/165 |
| CN | 111326132 | A | | 6/2020 | |
| KR | 20050110592 | A | * | 11/2005 | |
| WO | WO-2014025819 | A1 | * | 2/2014 | G10H 1/02 |
| WO | 2016007899 | A1 | | 1/2016 | |
| WO | WO-2016009444 | A2 | * | 1/2016 | G10H 1/366 |
| WO | WO-2021148009 | A1 | * | 7/2021 | G10H 1/0008 |

OTHER PUBLICATIONS

The State Intellectual Property Office of People's Republic of China, First Office Action in Patent Application No. CN202010074552.2 dated Apr. 1, 2021, which is a foreign counterpart application corresponding to this U.S. Patent Application, to which this application claims priority.

The State Intellectual Property Office of People's Republic of China, Second Office Action in Patent Application No. CN202010074552.2 dated Jun. 17, 2021, which is a foreign counterpart application corresponding to this U.S. Patent Application, to which this application claims priority.

Notification of completion of formalities for patent register and notification to grant patent right for invention application No. 202010074552.2 dated Sep. 10, 2021.

Wang, Yi; "Equalization and Reverb Tuning Tips", AV Technology, Dec. 31, 2012.

Kim, Hyemi, et al.; "Representation Learning for Background Music Identification in Television Shows", 2019 International Conference on Information and Communication Technology Convergence (ICTC), Dec. 31, 2019.

Extended European Search Report Communication Pursuant to Rule 62 EPC, dated Nov. 18, 2022 in Patent Application No. EP 21743735.9, which is a foreign counterpart application.

Yamaha, "Mixing Console" MGP16X, MGP12X: Owner's Manual, pp. 1-36, tempo, p. 14 paragraph "Built-in digital effects"; Jan. 1, 2007.

* cited by examiner

METHOD FOR PROCESSING AUDIO AND ELECTRONIC DEVICE

CROSS-REFERENCE TO RELATED APPLICATION

This application is a continuation application of International Application No. PCT/CN2021/073380, filed on Jan. 22, 2021, which claims priority to Chinese Patent Application No. 202010074552.2, filed on Jan. 22, 2020, the disclosures of which are herein incorporated by reference in their entireties.

TECHNICAL FIELD

The present disclosure relates to the field of signal processing technologies, and in particular, relates to a method for processing audio and an electronic device.

BACKGROUND

For a long time, singing has been a common recreational activity. Nowadays, with the continuous innovation of electronic devices such as smart phones or tablet computers, users may sing songs through applications installed on the electronic devices, and may even realize the Karaoke sound effect without going to KTV.

SUMMARY

The present disclosure provides a method for processing audio and an electronic device. The technical solutions of the present disclosure are as follows:

According to one aspect of embodiments of the present disclosure, a method for processing audio is provided. The method includes: acquiring an accompaniment audio signal and a vocal signal of a current to-be-processed musical composition; determining a target reverberation intensity parameter value of the acquired accompaniment audio signal, wherein the target reverberation intensity parameter value is configured to indicate a rhythm speed, an accompaniment type, and a performance score of a singer of the current to-be-processed musical composition, wherein the accompaniment type is characterized by frequency domain richness of the current to-be-processed musical composition, wherein the frequency domain richness is numerically represented by a frequency domain richness coefficient, the richer the accompaniment of the current to-be-processed musical composition is, the higher the corresponding frequency domain richness is, the frequency domain richness coefficient being determined based on amplitude information of a sequence of accompaniment audio frames, the sequence of accompaniment audio frame being acquired by transforming the accompaniment audio signal from a time domain to a frequency domain; and the performance score of the singer refers to a history song score or real-time song score of the singer; and reverberating the acquired vocal signal based on the target reverberation intensity parameter value.

According to another aspect of embodiments of the present disclosure, an electronic device is provided. The electronic device includes: a processor; and a memory configured to store one or more instructions executable by the processor; wherein the processor, when loading and executing the one or more instructions, is caused to perform: acquiring an accompaniment audio signal and a vocal signal of a current to-be-processed musical composition; determining a target reverberation intensity parameter value of the acquired accompaniment audio signal, wherein the target reverberation intensity parameter value is configured to indicate a rhythm speed, an accompaniment type, and a performance score of a singer of the current to-be-processed musical composition, wherein the accompaniment type is characterized by frequency domain richness of the current to-be-processed musical composition, wherein the frequency domain richness is numerically represented by a frequency domain richness coefficient, the richer the accompaniment of the current to-be-processed musical composition is, the higher the corresponding frequency domain richness is, the frequency domain richness coefficient being determined based on amplitude information of a sequence of accompaniment audio frames, the sequence of accompaniment audio frame being acquired by transforming the accompaniment audio signal from a time domain to a frequency domain; and the performance score of the singer refers to a history song score or real-time song score of the singer; and reverberating the acquired vocal signal based on the target reverberation intensity parameter value.

In still another aspect of embodiments of the present disclosure, a non-volatile storage medium is provided. The storage medium stores one or more instructions therein, wherein the one or more instructions, when loaded and executed by a processor of an electronic device, cause the electronic device to perform: acquiring an accompaniment audio signal and a vocal signal of current to-be-processed musical composition; determining a target reverberation intensity parameter value of the acquired accompaniment audio signal, wherein the accompaniment type is characterized by frequency domain richness of the current to-be-processed musical composition, wherein the frequency domain richness is numerically represented by a frequency domain richness coefficient, the richer the accompaniment of the current to-be-processed musical composition is, the higher the corresponding frequency domain richness is, the frequency domain richness coefficient being determined based on amplitude information of a sequence of accompaniment audio frames, the sequence of accompaniment audio frame being acquired by transforming the accompaniment audio signal from a time domain to a frequency domain; and the performance score of the singer refers to a history song score or real-time song score of the singer; and reverberating the acquired vocal signal based on the target reverberation intensity parameter value.

DETAILED DESCRIPTION

Figure 1:
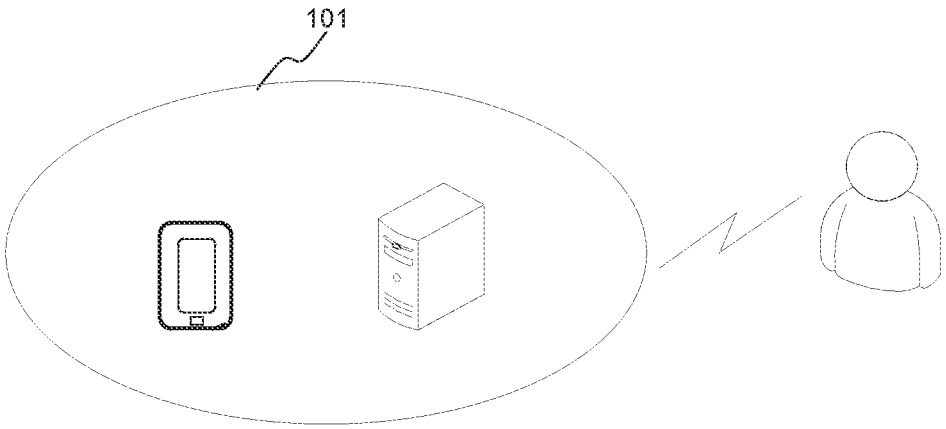
FIG. 1 is a schematic diagram of an implementation environment of a method for processing audio according to an embodiment of the present disclosure.

User information involved in the present disclosure is authorized by a user or fully authorized by all parties. The expression "at least one of A, B, and C" includes the following cases: A exists alone, B exists alone, C exists alone, A and B exist concurrently, A and C exist concurrently, B and C exist concurrently, and A, B, and C exist concurrently.

Before explaining embodiments of the present disclosure in detail, some terms or abbreviations involved in the embodiments of the present disclosure are introduced firstly.

Karaoke sound effect: the Karaoke sound effect means that by performing audio processing on acquired vocals and background music, the processed vocals are more pleasing than the vocals before processing, and the problems of inaccuracy pitch of a part of the vocals and the like can be solved. In short, the karaoke sound effect is configured to modify the acquired vocals.

Background music (BGM): short for accompaniment music or incidental music. Broadly speaking, the BGM usually refers to a kind of music for adjusting the atmosphere in TV series, movies, animations, video games, and websites, which is inserted into the dialogue to enhance the expression of emotions and achieve an immersive feeling for the audience. In addition, the music played in some public places (such as bars, cafes, shopping malls, or the like) is also called background music. In the embodiments of the present disclosure, the BGM refers to a song accompaniment for a singing scenario.

Short-time Fourier transform (STFT): a mathematical transform related to Fourier transform and configured to determine the frequency and phase of a sine wave in a local region of a time-varying signal. That is, a long non-stationary signal is regarded as the superposition of a series of short-time stationary signals, and the short-time stationary signal is achieved through a windowing function. In other words, a plurality of segments of signals are extracted and then Fourier transformed respectively. Time-frequency analysis characteristic of the STFT is that the characteristic at a certain moment is represented through a segment of signal in a time window.

Reverberation: reverberation is the phenomenon of persistence of sounds after the sound source has stopped making sounds. Sound waves are reflected by obstacles such as walls, ceilings, or floors during propagating indoors, and are partially absorbed by these obstacles during each reflection. In this way, after the sound source has stopped making sounds, the sound waves are reflected and absorbed many times indoors and finally disappear. Persons will feel that there are several sound waves mixed and lasting for a while after the sound source has stopped making sounds. That is, reverberation is the phenomenon of persistence of sounds after the sound source has stopped making sounds. In some embodiments, reverberation is mainly configured to sing karaoke, increase the delay of sounds from a microphone, and generate an appropriate amount of echo, thereby making the singing sounds richer and more beautiful rather than being empty and tinny. That is, for the singing sounds of karaoke, to achieve a better effect and make the sounds less empty and tinny, generally reverberation is artificially added in the later stage to make the sounds richer and more beautiful.

The following introduces an implementation environment involved in a method for processing audio according to embodiments of the present disclosure.

Referring to FIG. 1, the implementation environment includes an electronic device 101 for audio processing. The electronic device 101 is a terminal or a server, which is not specifically limited in the embodiments of the present disclosure. By taking the terminal as an example, the types of the terminal include but are not limited to mobile terminals and fixed terminals.

In some embodiments, the mobile terminals include smart phones, tablet computers, laptop computers, e-readers, moving picture experts group audio layer III (MP3) players, moving picture experts group audio layer IV (MP4) players, and the like; and the fixed terminals include desktop computers, which are not specifically limited in the embodiment of the present disclosure.

In some embodiments, a music application with an audio processing function is usually installed on the terminal to execute the method for processing the audio according to the embodiments of the present disclosure. Moreover, in addition to executing the method, the terminal may further upload a to-be-processed audio signal to a server through a music application or a video application, and the server executes the method for processing the audio according to the embodiments of the present disclosure and returns a result to the terminal, which is not specifically limited in the embodiments of the present disclosure.

Based on the above implementation environment, for making sounds richer and more beautiful, the electronic device 101 usually reverberates the acquired vocal signals artificially.

In short, after an accompaniment audio signal (also known as a BGM audio signal) and a vocal signal are acquired, a sequence of the BGM audio signal frames is acquired by transforming the BGM audio signal from a time domain to a frequency domain through the short-time Fourier transform. Afterward, amplitude information of each of the accompaniment audio frames is acquired, and based on this, the frequency domain richness of the amplitude information of each of the accompaniment audio frames is calculated. In addition, a number of beats of the BGM audio signal within a specified duration (such as per minute) may be acquired, and based on this, a rhythm speed of the BGM audio signal is calculated.

Usually, for songs with simple background music accompaniment components (such as pure guitar accompaniment) and a low speed, small reverberation may be added to make vocals purer, and for songs with diverse background music accompaniment components (such as band song accompaniment) and a high speed, large reverberation may be added to enhance the atmosphere and highlight the vocals.

In the embodiments of the present disclosure, for songs of different rhythms and accompaniment types, and different parts and different singers of the same song, the most suitable reverberation intensity values may be dynamically calculated or pre-calculated, and then an artificial reverberation algorithm is directed to control the magnitude of reverberation of the output vocals to achieve an adaptive Karaoke sound effect. In other words, in the embodiment of the present disclosure, a plurality of factors such as the frequency domain richness, the rhythm speed, and the singer of the song are comprehensively considered, and based on this, different reverberation intensity values are generated adaptively, thereby achieving the adaptive Karaoke sound effect.

The method for processing the audio according to the embodiments of the present disclosure is explained in detail below through the following embodiments.

Figure 2:
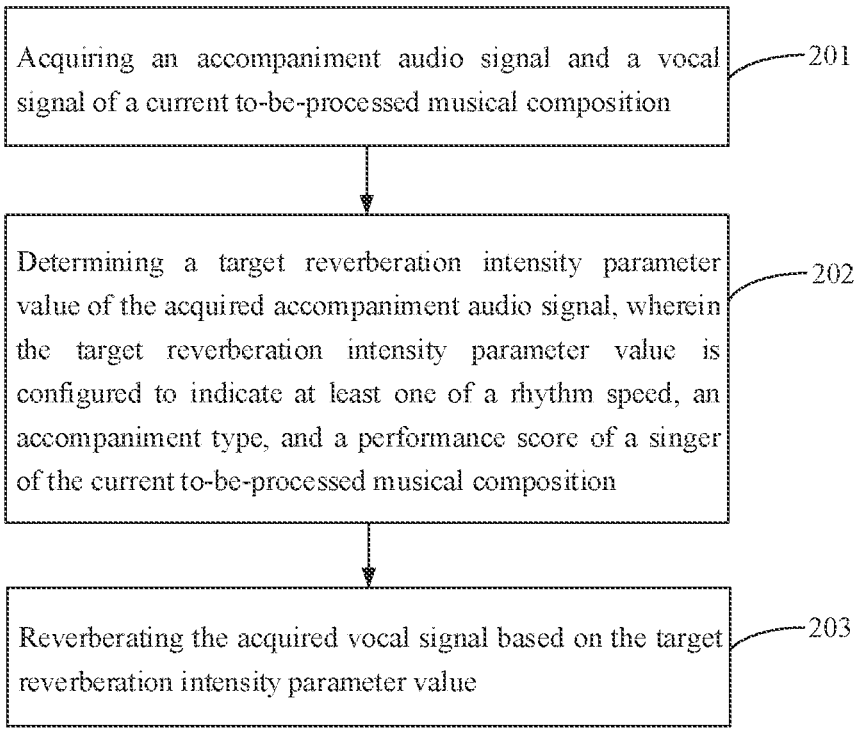
FIG. 2 is a flowchart of a method for processing audio according to an embodiment of the present disclosure.

FIG. 2 is a flowchart of a method for processing audio according to an embodiment. As shown in FIG. 2, the method for processing the audio is executed by an electronic device and includes the following steps.

In 201, an accompaniment audio signal and a vocal signal of a current to-be-processed musical composition are acquired.

In 202, a target reverberation intensity parameter value of the acquired accompaniment audio signal is determined, wherein the target reverberation intensity parameter value is configured to indicate at least one of a rhythm speed, an accompaniment type, and a performance score of a singer of the current to-be-processed musical composition.

In 203, the acquired vocal signal is reverberated based on the target reverberation intensity parameter value.

The method according to the embodiments of the present disclosure determines the reverberation intensity value by considering a plurality of factors such as the accompaniment type, the rhythm speed, and the performance score of the singer, and based on this the reverberation intensity value of the current to-be-processed musical composition, the vocal signal is processed to adaptively achieve the adaptive Karaoke sound effect, such that sounds output by the electronic device are richer and more beautiful.

In some embodiments, determining the target reverberation intensity parameter value of the acquired accompaniment audio signal includes: determining a first reverberation intensity parameter value of the acquired accompaniment audio signal, wherein the first reverberation intensity parameter value is configured to indicate the accompaniment type of the current to-be-processed musical composition; determining a second reverberation intensity parameter value of the acquired accompaniment audio signal, wherein the second reverberation intensity parameter value is configured to indicate the rhythm speed of the current to-be-processed musical composition; determining a third reverberation intensity parameter value of the acquired accompaniment audio signal, wherein the third reverberation intensity parameter value is configured to indicate the performance score of the singer of the current to-be-processed musical composition; and determining the target reverberation intensity parameter value based on the first reverberation intensity parameter value, the second reverberation intensity parameter value, and the third reverberation intensity parameter value.

In some embodiments, determining the first reverberation intensity parameter value of the acquired accompaniment audio signal includes: acquiring a sequence of accompaniment audio frames by transforming the acquired accompaniment audio signal from a time domain to a frequency domain; acquiring amplitude information of each of the accompaniment audio frames is acquired; determining a frequency domain richness coefficient of each of the accompaniment audio frames based on the amplitude information of each of the accompaniment audio frames, wherein the frequency domain richness coefficient is configured to indicate frequency domain richness of the amplitude information of each of the accompaniment audio frames, the frequency domain richness reflecting the accompaniment type of the current to-be-processed musical composition; and determining the first reverberation intensity parameter value based on the frequency domain richness coefficient of each of the accompaniment audio frames.

In some embodiments, determining the first reverberation intensity parameter value based on the frequency domain richness coefficient of each of the accompaniment audio frames includes: determining a global frequency domain richness coefficient of the current to-be-processed musical composition based on the frequency domain richness coefficient of each of the accompaniment audio frames; and acquiring a first ratio of the global frequency domain richness coefficient to a maximum frequency domain richness coefficient, and determining a minimum of the first ratio and a target value as the first reverberation intensity parameter value.

In some embodiments, determining the first reverberation intensity parameter value based on the frequency domain richness coefficient of each of the accompaniment audio frames includes: generating a waveform for indicating the frequency domain richness based on the frequency domain richness coefficient of each of the accompaniment audio frames; smoothing the generated waveform, and determining frequency domain richness coefficients of different parts of the current to-be-processed musical composition based on the smoothed waveform; acquiring a second ratio of the frequency domain richness coefficient of each of the different parts to a maximum frequency domain richness coefficient; and determining, for each acquired second ratio, a minimum of the second ratio and a target value as the first reverberation intensity parameter value.

In some embodiments, determining the second reverberation intensity parameter value of the acquired accompaniment audio signal includes: acquiring a number of beats of the acquired accompaniment audio signal within a specified duration; acquiring a third ratio of the acquired number of beats to a maximum number of beats; and determining a minimum of the third ratio and a target value as the second reverberation intensity parameter value.

In some embodiments, determining the third reverberation intensity parameter value of the acquired accompaniment audio signal includes: acquiring an audio performance score of the singer of the current to-be-processed musical composition, and determining the third reverberation intensity parameter value based on the audio performance score.

In some embodiments, determining the target reverberation intensity parameter value based on the first reverberation intensity parameter value, the second reverberation intensity parameter value, and the third reverberation intensity parameter value includes: acquiring a basic reverberation intensity parameter value, a first weight value, a second weight value, and a third weight value; determining a first sum value of the first weight value and the first reverberation intensity parameter value; determining a second sum value of the second weight value and the second reverberation intensity parameter value; determining a third sum value of the third weight value and the third reverberation intensity parameter value; and acquiring a fourth sum value of the basic reverberation intensity parameter value, the first sum value, the second sum value, and the third sum value, and determining a minimum of the fourth sum value and a target value as the target reverberation intensity parameter value.

In some embodiments, reverberating the acquired vocal signal based on the target reverberation intensity parameter value includes: adjusting a total reverberation gain of the acquired vocal signal based on the target reverberation intensity parameter value; or adjusting at least one reverberation algorithm parameter of the acquired vocal signal based on the target reverberation intensity parameter value.

In some embodiments, the method further includes: mixing the acquired accompaniment audio signal and the reverberated vocal signal, and outputting the mixed audio signal.

All the above optional technical solutions may be combined in any way to form an optional embodiment of the present disclosure, which is not described in detail herein.

Figure 3:
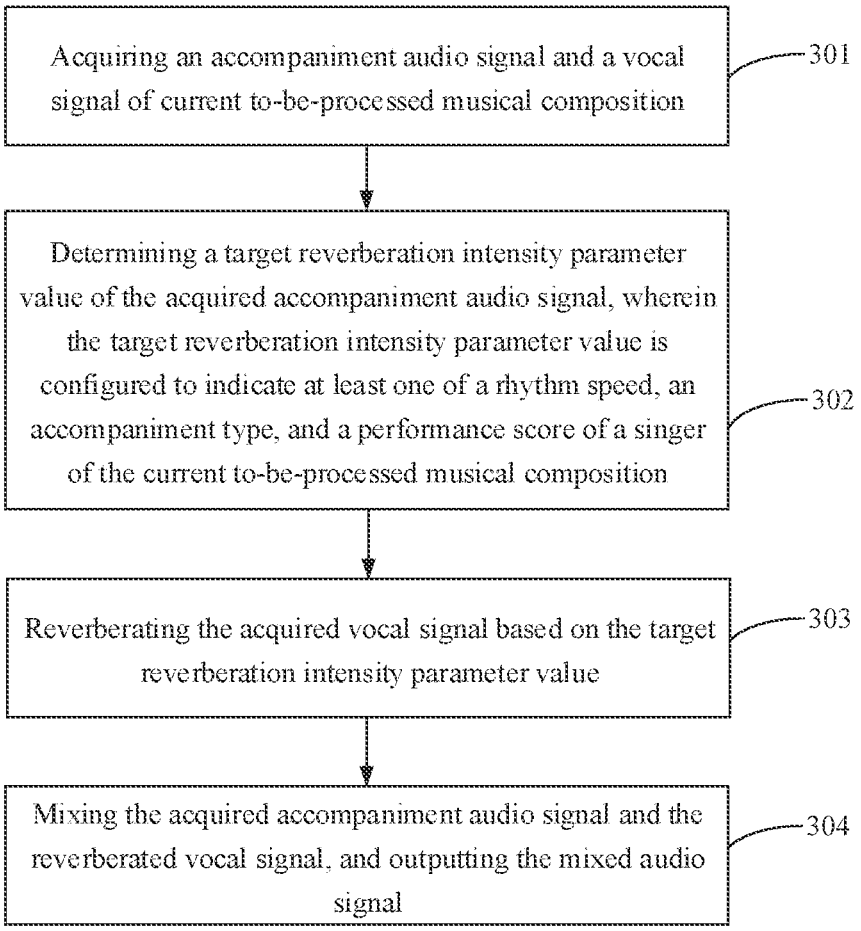
FIG. 3 is a flowchart of another method for processing audio according to an embodiment of the present disclosure.

FIG. 3 is a flowchart of a method for processing audio according to an embodiment. The method for processing the audio is executed by an electronic device. Combined with the overall system block diagram shown in FIG. 4, the method for processing the audio includes the following steps.

In 301, an accompaniment audio signal and a vocal signal of a current to-be-processed musical composition are acquired.

The current to-be-processed musical composition is a song being sung by a user currently and correspondingly, the accompaniment audio signal may also be referred to as a background music accompaniment or BGM audio signal in this application. Taking that the electronic device is a smart phone as an example, the electronic device acquires the accompaniment audio signal and the vocal signal of the current to-be-processed musical composition through its microphone or an external microphone.

In 302, a target reverberation intensity parameter value of the acquired accompaniment audio signal is determined, wherein the target reverberation intensity parameter value is configured to indicate at least one of a rhythm speed, an accompaniment type, and a performance score of a singer of the current to-be-processed musical composition.

Usually, a basic principle for reverberating is that: for songs with simple background music accompaniment components (such as pure guitar accompaniment) and a low speed, small reverberation will be added to make the vocals purer; and for songs with diverse background music accompaniment components (such as band song accompaniment) and a high speed, large reverberation will be added to enhance the atmosphere and highlight the vocals.

That the target reverberation intensity parameter value is configured to indicate at least one of the rhythm speed, the accompaniment type, and the performance score of the singer of the current to-be-processed musical composition includes the following cases: the target reverberation intensity parameter value is configured to indicate the rhythm speed of the current to-be-processed musical composition; the target reverberation intensity parameter value is configured to indicate the accompaniment type of the current to-be-processed musical composition; the target reverberation intensity parameter value is configured to indicate the performance score of the singer of the current to-be-processed musical composition; the target reverberation intensity parameter value is configured to indicate the rhythm speed and the accompaniment type of the current to-be-processed musical composition; the target reverberation intensity parameter value is configured to indicate the rhythm speed and the performance score of the singer of the current to-be-processed musical composition; the target reverberation intensity parameter value is configured to indicate the accompaniment type and the performance score of the singer of the current to-be-processed musical composition; and the target reverberation intensity parameter value is configured to indicate the rhythm speed, the accompaniment type, and the performance score of the singer of the current to-be-processed musical composition.

Figure 5:
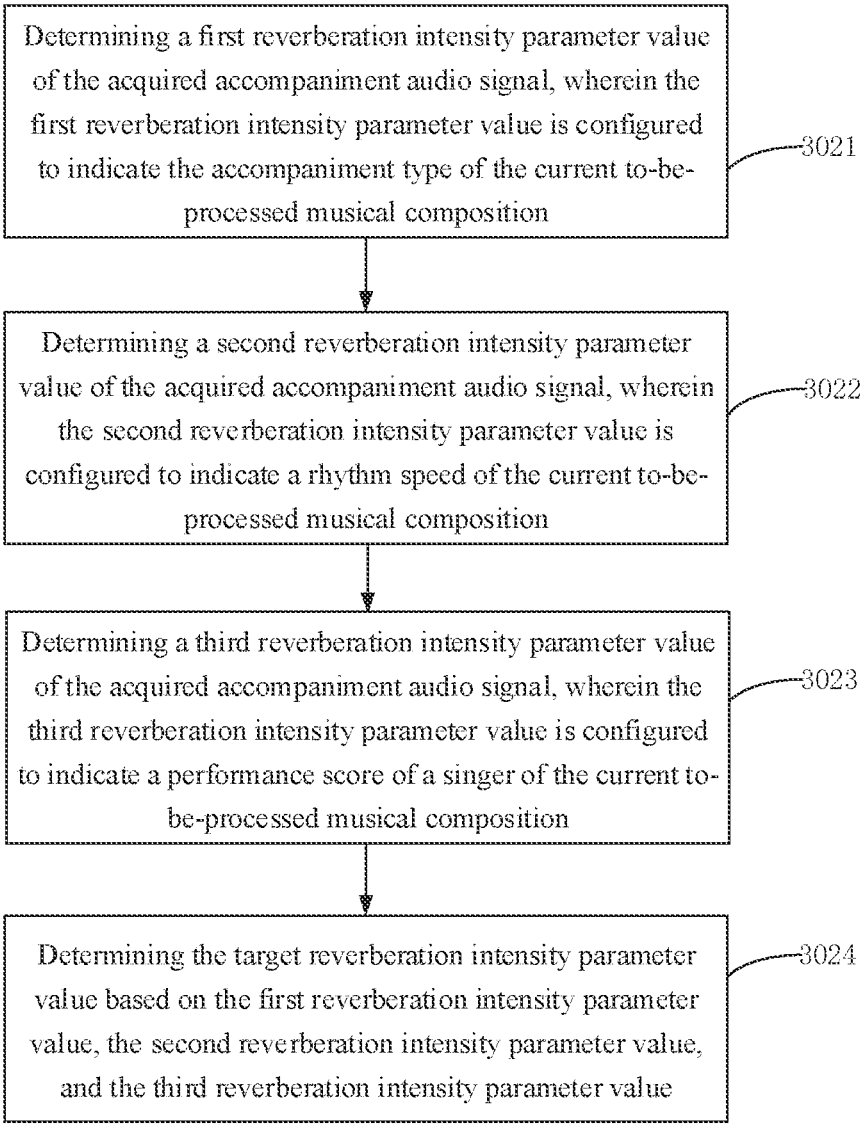
FIG. 5 is a flowchart of a further method for processing audio according to an embodiment of the present disclosure.

In some embodiments, as shown in FIG. 5, determining the target reverberation intensity parameter value of the acquired accompaniment audio signal includes the following steps.

In 3021, a first reverberation intensity parameter value of the acquired accompaniment audio signal is determined, wherein the first reverberation intensity parameter value is configured to indicate the accompaniment type of the current to-be-processed musical composition.

In the embodiments of the present disclosure, the accompaniment type of the current to-be-processed musical composition is characterized by frequency domain richness. The richer the accompaniment of the song itself is, the higher the corresponding frequency domain richness is; and vice versa. In other words, a song with a complex accompaniment has a larger frequency domain richness coefficient than a song with a simple accompaniment. The frequency domain richness coefficient is configured to indicate the frequency domain richness of amplitude information of each of the accompaniment audio frames, that is, the frequency domain richness reflects the accompaniment type of the current to-be-processed musical composition.

In some embodiments, determining the first reverberation intensity parameter value of the acquired accompaniment audio signal includes the following processes.

A sequence of accompaniment audio frames is acquired by transforming the acquired accompaniment audio signal from a time domain to a frequency domain.

Figure 4:
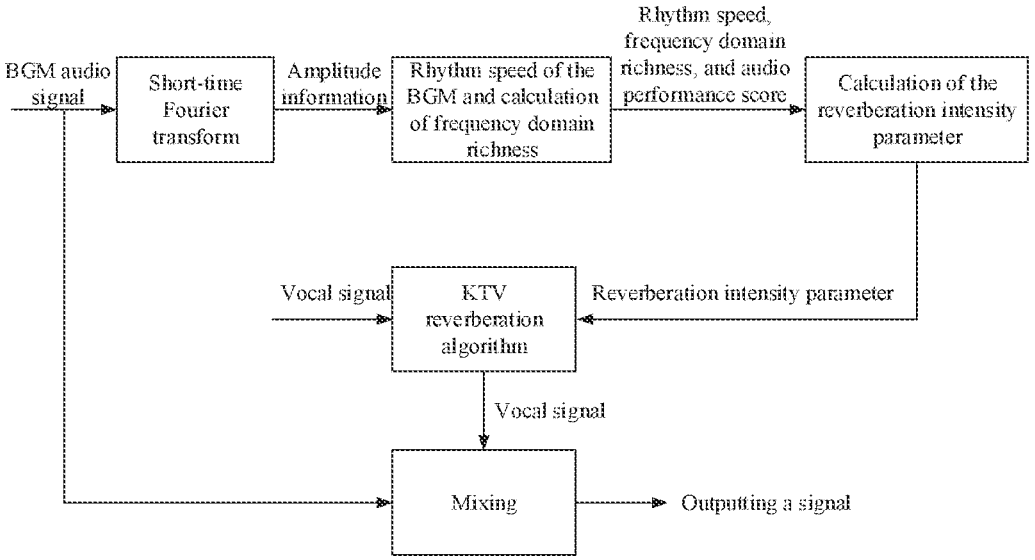
FIG. 4 is an overall system block diagram of a method for processing audio according to an embodiment of the present disclosure.

As shown in FIG. 4, in the embodiments of the present disclosure, a short-time Fourier transform is performed on the BCM audio signal of the current to-be-processed musical composition to transform the BCM audio signal from the time domain to the frequency domain.

For example, in the case that an audio signal x with a length T is x(t) in a time domain, wherein t represents time and $0<t\leq T$, after short-time Fourier transform, x(t) is represented as X (n, k)=STFT(X(t)) in a frequency domain, wherein n represents any frame in the acquired sequence of accompaniment audio frames, $0<n\leq N$, N represents the total number of frames, k represents any frequency in a center frequency sequence, $0<k\leq K$, and K represents the total number of frequencies.

Amplitude information of each of the accompaniment audio frames is acquired; and a frequency domain richness coefficient of each of the accompaniment audio frames is determined based on the amplitude information of each of the accompaniment audio frames.

The amplitude information and phase information of each of the accompaniment audio frames are acquired after the acquired accompaniment audio signal is transformed from the time domain to the frequency domain through the short-time Fourier transform. In some embodiments, the amplitude of each of the accompaniment audio frames Mag is determined through the following formula. That is, the amplitude of the BGM audio signal in the frequency domain is Mag(n,k)=abs(X(n,k)).

Correspondingly, the frequency domain richness SpecRichness of each of the accompaniment audio frames, that is, the frequency domain richness coefficient is:

$$SpecRichness(n) = \frac{\Sigma_k \; Mag(n, k) \cdot k}{\Sigma_k \; Mag(n, k)}.$$

Figure 6:
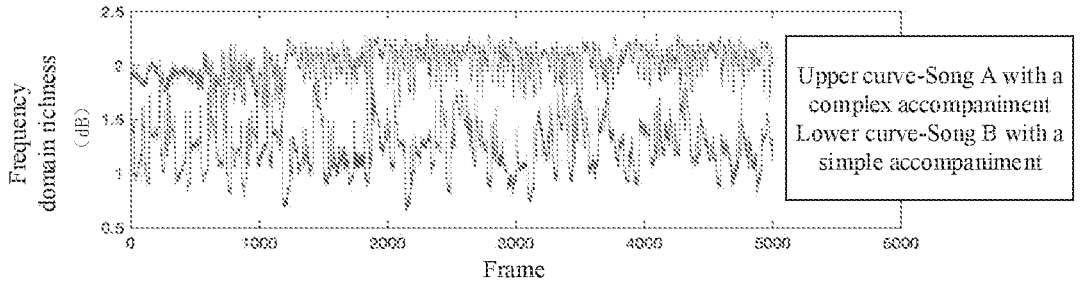
FIG. 6 is a waveform about frequency domain richness according to an embodiment of the present disclosure.
Figure 7:
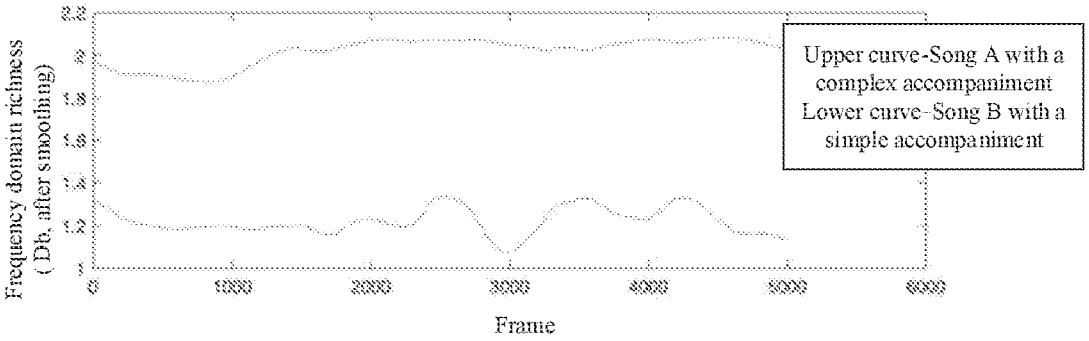
FIG. 7 is a smoothed waveform about frequency domain richness according to an embodiment of the present disclosure.

It should be noted that for a song, the richer the accompaniment of the song itself is, the higher the corresponding frequency domain richness is; and vice versa. In some embodiments, FIG. 6 shows the frequency domain richness of two songs. As the accompaniment of song A is complex and the accompaniment of song B is simpler than the former, the frequency domain richness of song A is higher than that of song B. FIG. 6 shows the originally calculated SpecRichness about these two songs, and FIG. 7 shows the smoothed SpecRichness. It can be seen from FIG. 6 and FIG. 7 that the song with the complex accompaniment has higher SpecRichness than the song with the simple accompaniment.

The first reverberation intensity parameter value is determined based on the frequency domain richness coefficient of each of the accompaniment audio frames.

In the embodiments of the present disclosure, one implementation is to allocate different reverberation to different songs through the pre-calculated global SpecRichness.

That is, in some embodiments, determining the first reverberation intensity parameter value based on the frequency domain richness coefficient of each of the accompaniment audio frames includes: determining a global frequency domain richness coefficient of the current to-be-processed musical composition based on the frequency domain richness coefficient of each of the accompaniment audio frames; and acquiring a first ratio of the global frequency domain richness coefficient to a maximum frequency domain richness coefficient, and determining a minimum of the first ratio and a target value as the first reverberation intensity parameter value.

In some embodiments, the global frequency domain richness coefficient is an average of the frequency domain richness coefficients of each of the accompaniment audio frames, which is not specifically limited in the embodiment of the present disclosure. In addition, the target value refers to 1 in this application. Correspondingly, the formula for calculating the first reverberation intensity parameter value through the calculated SpecRichness is:

$$G_{SpecRichness} = \min\left(1, \frac{SpecRichness}{\text{SpecRichness_max}}\right),$$

where $G_{SpecRichness}$ represents the first reverberation intensity parameter value, and SpecRichness_max represents the preset maximum allowable SpecRichness value.

In the embodiments of the present disclosure, another implementation is to allocate different reverberation to different parts of each song through the smoothed SpecRichness. For example, the reverberation of a chorus part of the song is strong, as shown by an upper curve in FIG. 7.

That is, in other embodiments, determining the first reverberation intensity parameter value based on the frequency domain richness coefficient of each of the accompaniment audio frames includes: generating a waveform for indicating the frequency domain richness based on the frequency domain richness coefficient of each of the accompaniment audio frames (an example is shown in FIG. 7); smoothing the generated waveform, and determining frequency domain richness coefficients of different parts of the current to-be-processed musical composition based on the smoothed waveform; acquiring a second ratio of the frequency domain richness coefficient of each of the different parts to a maximum frequency domain richness coefficient; and determining, for each acquired second ratio, a minimum of the second ratio and a target value as the first reverberation intensity parameter value. It should be noted that the determination of reverberation intensity value is not limited to the above steps.

For this implementation, for one song, a plurality of first reverberation intensity parameter values are calculated through the calculated SpecRichness.

In some embodiments, the frequency domain richness coefficient of each of the different parts is an average of the frequency domain richness coefficients of each of the accompaniment audio frames of the corresponding part, which is not specifically limited in the embodiment of the present disclosure. The above different parts at least include a verse part and a chorus part.

In 3022, a second reverberation intensity parameter value of the acquired accompaniment audio signal is determined, wherein the second reverberation intensity parameter value is configured to indicate the rhythm speed of the current to-be-processed musical composition.

In the embodiments of the present disclosure, the rhythm speed of the current to-be-processed musical composition is characterized by the number of beats. That is, in some embodiments, determining the second reverberation intensity parameter value of the acquired accompaniment audio signal includes: acquiring a number of beats of the acquired accompaniment audio signal within a specified duration; acquiring a third ratio of the acquired number of beats to a maximum number of beats; and determining a minimum of the third ratio and a target value as the second reverberation intensity parameter value.

In some embodiments, the number of beats within the specified duration is the number of beats per minute. It should be noted that the target duration is preset according to actual needs, which is not specifically limited in the embodiment of the present disclosure. Beat per minute (BPM) represents the unit of the number of beats per minute, that is, the number of sound beats emitted within a time period of one minute, the unit of which is the BPM. The BPM is also called the number of beats. The target value is 1.

The number of beats of the current to-be-processed musical composition is acquired through an analysis algorithm of the number of beats. Correspondingly, the calculation formula of the second reverberation intensity parameter value is:

$$G_{bgm} = \min\left(1, \frac{BGM}{\text{BGM_max}}\right),$$

wherein $G_{bgm}$ represents the second reverberation intensity parameter value, and BGM represents the calculated number of beats per minute, and BGM_max represents the predetermined maximum allowable number of beats per minute.

In 3023, a third reverberation intensity parameter value of the acquired accompaniment audio signal is determined, wherein the third reverberation intensity parameter value is configured to indicate the performance score of the singer of the current to-be-processed musical composition.

Usually, a singer with a good singing skill (a higher performance score) prefers small reverberation, and a singer with a poor singing skill (a lower performance score) prefers large reverberation. In some embodiments, in the embodiment of the present disclosure, the reverberation intensity may also be controlled by extracting the performance score (audio performance score) of the singer of the current to-be-processed musical composition. That is, in some embodiments, determining the third reverberation intensity parameter value of the acquired accompaniment audio signal includes: acquiring an audio performance score of the singer of the current to-be-processed musical composition, and determining the third reverberation intensity parameter value based on the audio performance score.

In some embodiments, the audio performance score refers to a history song score or real-time song score of the singer, and the history song score is the song score within the last month, the last three months, the last six months, or the last one year, which is not specifically limited in the embodiment of the present disclosure. The full score of the song score is 100.

Correspondingly, the calculation formula of the third reverberation intensity parameter value is:

$$G_{vocalGoodness} = 1 - \frac{\text{KTV_Score}}{100},$$

where $G_{vocalGoddness}$ represents the third reverberation intensity parameter value, and KTV_Score represents the acquired audio performance score.

In 3024, the target reverberation intensity parameter value is determined based on the first reverberation intensity parameter value, the second reverberation intensity parameter value, and the third reverberation intensity parameter value.

In some embodiments, determining the target reverberation intensity parameter value is determined based on the first reverberation intensity parameter value, the second reverberation intensity parameter value, and the third reverberation intensity parameter value includes:

acquiring a basic reverberation intensity parameter value, a first weight value, a second weight value, and a third weight value; determining a first sum value of the first weight value and the first reverberation intensity parameter value; determining a second sum value of the second weight value and the second reverberation intensity parameter value; determining a third sum value of the third weight value and the third reverberation intensity parameter value; and determining a fourth sum value of the basic reverberation intensity parameter value, the first sum value, the second sum value and the third sum value, and determining a minimum of the fourth sum value and a target value as the target reverberation intensity parameter value. In some embodiments, the first sum value is a product of first weight value and the first reverberation intensity parameter value; the second sum value is a product of second weight value and the second reverberation intensity parameter value; and the third sum value is a product of third weight value and the third reverberation intensity parameter value. The fourth sum value is a sum of the basic reverberation intensity parameter value, the first sum value, the second sum value and the third sum value. The target reverberation intensity parameter value is a minimum of a target value and the fourth sum value. In some embodiments, the target value is 1.

Correspondingly, the calculation formula of the target reverberation intensity parameter value is:

$$G_{reverb} = \min(1, G_{reverb_0} + w_{SpecRichness} G_{SpecRichness} + w_{bgm} G_{bgm} + w_{vocalGoodness} G_{vocalGoodness}),$$

wherein $G_{reverb}$ represents the target reverberation intensity parameter value, $G_{reverb_0}$ represents the predetermined basic reverberation intensity parameter value, $w_{SpecRichness}$ represents the first weight value corresponding to the first reverberation intensity parameter value $G_{SpecRichness}$, $w_{bgm}$ represents the second weight value corresponding to the second reverberation intensity parameter value $G_{bgm}$, and $w_{vocalGoodness}$ represents the third weight value corresponding to the third reverberation intensity parameter value $G_{vocalGoodness}$. That is, the first sum value is $w_{specRichness}$ times $G_{SpecRichness}$, the second sum value is $w_{bgm}$ times $G_{bgm}$ and the third sum value is $w_{vocalGoodness}$ times $G_{vocalGoodness}$.

In some embodiments, the above three weight values may be set according to the magnitude of the influences on the reverberation intensity. For example, the first weight value is maximum and the second weight value is minimum, which is not specifically limited in the embodiments of the present disclosure.

In step 303, the acquired vocal signal is reverberated based on the target reverberation intensity parameter value.

In the embodiments of the present disclosure, as shown in FIG. 4, a KTV reverberation algorithm includes two layers of parameters, one is the total reverberation gain, and the other is the internal parameters of the reverberation algorithm. Thus, the purpose of controlling the reverberation intensity can be achieved by directly controlling the magnitude of energy of the reverberation part. In some embodiments, reverberating the acquired vocal signal based on the target reverberation intensity parameter value includes:

adjusting a total reverberation gain of the acquired vocal signal based on the target reverberation intensity parameter value; or adjusting at least one reverberation algorithm parameter of the acquired vocal signal based on the target reverberation intensity parameter value. That is, $G_{reverb}$ can not only be directly loaded as the total reverberation gain, but also can be loaded to one or more parameters within the reverberation algorithm, for example, adjusting the echo gain, delay time, and feedback network gain, which is not specifically limited in the embodiments of the present disclosure.

In step 304, the acquired accompaniment audio signal and the reverberated vocal signal are mixed, and the mixed audio signal is output.

As shown in FIG. 4, after the vocal signal is processed with the KTV reverberation algorithm, the acquired accompaniment audio signal and the reverberated vocal signal are mixed. After mixing, the audio signal can be output directly, for example, the mixed audio signal is played through a loudspeaker of the electronic device, to achieve the KTV sound effect.

In the embodiments of the present disclosure, for songs of different rhythm speeds and different accompaniment types, different parts of the same song, and songs of different signers, the most suitable reverberation intensity values are dynamically calculated or pre-calculated, and then an artificial reverberation algorithm is directed to control the magnitude of reverberation of the output vocals to achieve an adaptive Karaoke sound effect.

In other words, in the embodiments of the present disclosure, a plurality of factors such as the frequency domain richness, the rhythm speed, and the singer of the song are comprehensively considered. For example, for the frequency domain richness, the rhythm speed, and the singer of the music, different reverberation intensity values are generated adaptively. For various reverberation intensity values that affect the reverberation intensity, the embodiments of the present disclosure also provides a fusion method, and finally, the total reverberation intensity value is acquired. The total reverberation intensity value can not only be added to the total reverberation gain, but also can be loaded to one or more parameters within the reverberation algorithm. Thus, this method for processing the audio achieves the adaptive Karaoke sound effect, making sounds output by the electronic device richer and more beautiful.

Figure 8:
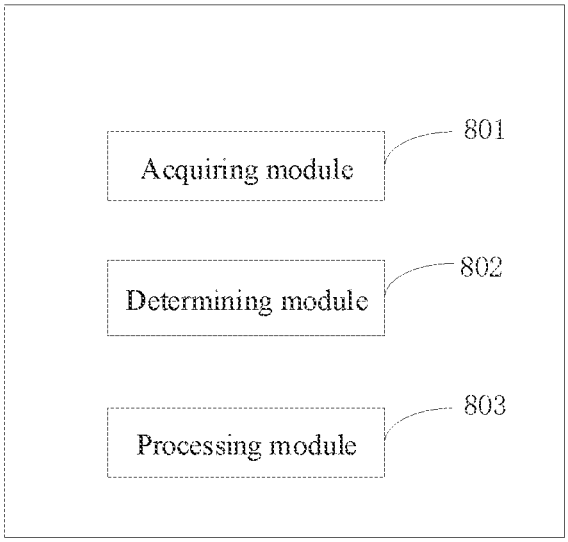
FIG. 8 is a block diagram of an apparatus for processing audio according to an embodiment of the present disclosure.

FIG. 8 is a block diagram of an apparatus for processing audio according to an embodiment. Referring to FIG. 8, the apparatus includes an acquiring module 801, a determining module 802, and a processing module 803.

The collecting module 801 is configured to acquire an accompaniment audio signal and a vocal signal of a current to-be-processed musical composition.

The determining module 802 is configured to determine a target reverberation intensity parameter value of the acquired accompaniment audio signal, wherein the target reverberation intensity parameter value is configured to indicate at least one of a rhythm speed, an accompaniment type, and a performance score of a singer of the current to-be-processed musical composition.

The processing module 803 is configured to reverberate the acquired vocal signal based on the target reverberation intensity parameter value.

The apparatus according to the embodiment of the present disclosure has considered a plurality of factors such as the accompaniment type, the rhythm speed, and the performance score of the singer are considered, and accordingly, the reverberation intensity value of the current to-be-processed musical composition is generated adaptively to achieve the adaptive Karaoke sound effect, such that sounds output by the electronic device are richer and more beautiful.

In some embodiments, the determining module 802 is further configured to determine a first reverberation intensity parameter value of the acquired accompaniment audio signal, wherein the first reverberation intensity parameter value is configured to indicate the accompaniment type of the current to-be-processed musical composition; determine a second reverberation intensity parameter value of the acquired accompaniment audio signal, wherein the second reverberation intensity parameter value is configured to indicate the rhythm speed of the current to-be-processed musical composition; determine a third reverberation intensity parameter value of the acquired accompaniment audio signal, wherein the third reverberation intensity parameter value is configured to indicate the performance score of the singer of the current to-be-processed musical composition; and determine the target reverberation intensity parameter value based on the first reverberation intensity parameter value, the second reverberation intensity parameter value, and the third reverberation intensity parameter value.

In some embodiments, the determining module 802 is further configured to acquire a sequence of accompaniment audio frames by transforming the acquired accompaniment audio signal from a time domain to a frequency domain; acquire amplitude information of each of the accompaniment audio frames; determine a frequency domain richness coefficient of each of the accompaniment audio frames based on the amplitude information of each of the accompaniment audio frames, wherein the frequency domain richness coefficient is configured to indicate frequency domain richness of the amplitude information of each of the accompaniment audio frames; and determine the first reverberation intensity parameter value based on the frequency domain richness coefficient of each of the accompaniment audio frames.

In some embodiments, the determining module 802 is further configured to determine a global frequency domain richness coefficient of the current to-be-processed musical composition based on the frequency domain richness coefficient of each of the accompaniment audio frames; and acquire a first ratio of the global frequency domain richness coefficient to a maximum frequency domain richness coefficient and determine a minimum of the first ratio and a target value as the first reverberation intensity parameter value.

In some embodiments, the determining module 802 is further configured to generate a waveform for indicating the frequency domain richness based on the frequency domain richness coefficient of each of the accompaniment audio frames; smooth the generated waveform, and determine frequency domain richness coefficients of different parts of the current to-be-processed musical composition based on the smoothed waveform; acquire a second ratio of the frequency domain richness coefficient of each of the different parts to a maximum frequency domain richness coefficient; and determine, for each acquired second ratio, a minimum of the second ratio and a target value as the first reverberation intensity parameter value.

In some embodiments, the determining module 802 is further configured to acquire a number of beats of the acquired accompaniment audio signal within a specified duration; determine a third ratio of the acquired number of beats to a maximum number of beats; and determine a minimum of the third ratio and a target value as the second reverberation intensity parameter value.

In some embodiments, the determining module 802 is further configured to acquire an audio performance score of the singer of the current to-be-processed musical composition, and determine the third reverberation intensity parameter value based on the audio performance score.

In some embodiments, the determining module 802 is further configured to acquire a basic reverberation intensity parameter value, a first weight value, a second weight value, and a third weight value; determine a first sum value of the first weight value and the first reverberation intensity parameter value; determine a second sum value of the second weight value and the second reverberation intensity parameter value; determine a third sum value of the third weight value and the third reverberation intensity parameter value; and acquire a fourth sum value of the basic reverberation intensity parameter value, the first sum value, the second sum value, and the third sum value, and determine a minimum of the fourth sum value and a target value as the target reverberation intensity parameter value.

In some embodiments, the processing module 803 is further configured to adjust a total reverberation gain of the acquired vocal signal based on the target reverberation intensity parameter value; or adjust at least one reverberation algorithm parameter of the acquired vocal signal based on the target reverberation intensity parameter value.

In some embodiments, the processing module 803 is further configured to mix the acquired accompaniment audio signal and the reverberated vocal signal, and output the mixed audio signal.

Figure 9:
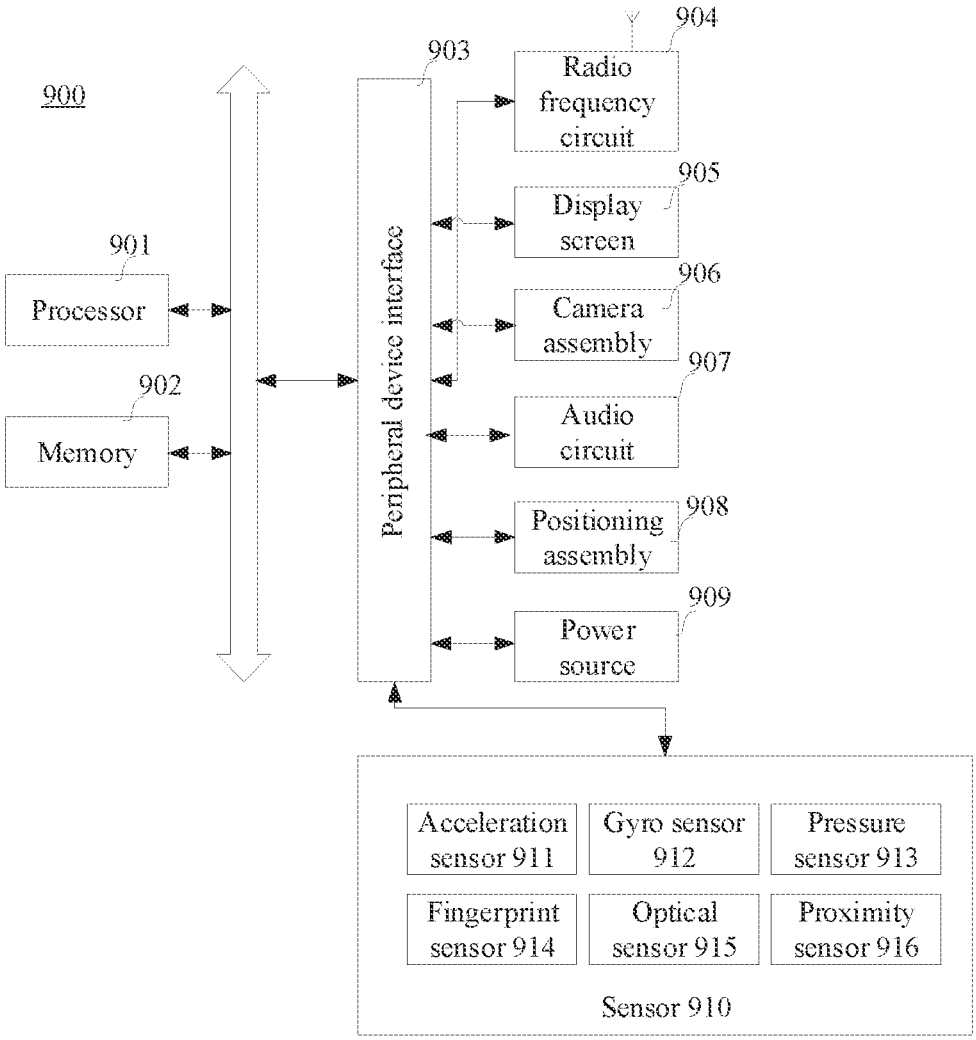
FIG. 9 is a block diagram of an electronic device according to an embodiment of the present disclosure.

FIG. 9 shows a structural block diagram of an electronic device 900 according to an embodiment of the present disclosure. The device 900 is a portable mobile terminal such as a smart phone, a tablet computer, a moving picture experts group audio layer III (MP3) player, a moving picture experts group audio layer IV (MP4) player, a laptop, or desk computer. The device 900 may also be called a user equipment, a portable terminal, a laptop terminal, a desk terminal, or the like.

Usually, the device 900 includes a processor 901 and a memory 902.

The processor 901 includes one or more processing cores, such as a 4-core processor and an 8-core processor. The processor 901 is implemented by at least one of hardware forms of a digital signal processing (DSP), a field-programmable gate array (FPGA), and a programmable logic array (PLA). The processor 901 also includes a main processor and a coprocessor. The main processor is a processor for processing the data in an awake state and is also called a central processing unit (CPU). The coprocessor is a low-power-consumption processor for processing the data in a standby state. In some embodiments, the processor 901 is integrated with a graphics processing unit (GPU), which is configured to render and draw the content that needs to be displayed on a display screen. In some embodiments, the processor 901 further includes an artificial intelligence (AI) processor configured to process computational operations related to machine learning.

The memory 902 includes one or more computer-readable storage media, which are non-transitory. The memory 902 may also include a high-speed random-access memory, as well as a non-volatile memory, such as one or more magnetic disk storage devices and flash storage devices.

In some embodiments, the device 900 further includes a peripheral device interface 903 and at least one peripheral device. The processor 901, the memory 902, and the peripheral device interface 903 are connected by a bus or a signal line. Each peripheral device is connected to the peripheral device interface 903 via a bus, a signal line, or a circuit board. In some embodiments, the peripheral device includes at least one of a radio frequency circuit 904, a display screen 905, a camera assembly 906, an audio circuit 907, a positioning assembly 908, and a power source 909.

The peripheral device interface 903 may be configured to connect at least one peripheral device associated with an input/output (I/O) to the processor 901 and the memory 902. In some embodiments, the processor 901, the memory 902, and the peripheral device interface 903 are integrated on the same chip or circuit board. In some other embodiments, any one or two of the processor 901, the memory 902, and the peripheral device interface 903 is or are implemented on a separate chip or circuit board, which is not limited in the present disclosure.

The radio frequency circuit 904 is configured to receive and transmit a radio frequency (RF) signal, which is also referred to as an electromagnetic signal. The radio frequency circuit 904 is communicated with a communication network and other communication devices via the electromagnetic signal. The radio frequency circuit 904 converts an electrical signal to the electromagnetic signal for transmission or converts the received electromagnetic signal to the electrical signal. In some embodiments, the radio frequency circuit 904 includes an antenna system, an RF transceiver, one or more amplifiers, a tuner, an oscillator, a digital signal processor, a coder/decoder (codec) chipset, a subscriber identity module (SIM) card, and the like. The radio frequency circuit 904 is communicated with other terminals in accordance with at least one wireless communication protocol. The wireless communication protocol includes the Internet, also referred to as the World Wide Web (WWW), a metropolitan area network (MAN), an intranet, various generations of mobile communication networks (2G, 3G, 4G, and 5G), a wireless local area network (LAN), and/or a wireless fidelity (Wi-Fi) network. In some embodiments, the radio frequency circuit 904 may further include near-field communication (NFC) related circuits, which is not limited in the present disclosure.

The display screen 905 is configured to display a user interface (UI). The UI includes graphics, texts, icons, videos, and any combination thereof. In the case that the display screen 905 is a touch display screen, the display screen 905 also can acquire a touch signal on or over the surface of the display screen 905. The touch signal is input into the processor 901 as a control signal for processing. In this case, the display screen 905 is further configured to provide virtual buttons and/or a virtual keyboard, which are also referred to as soft buttons and/or a soft keyboard. In some embodiments, one display screen 905 is disposed on the front panel of the device 900. In other embodiments, at least two display screens 905 are disposed on different surfaces of the device 900 respectively or in a folded design. In some embodiments, the display screen 905 is a flexible display screen disposed on a bending or folded surface of the device 900. Moreover, the display screen 905 may have an irregular shape other than a rectangle, that is, the display screen 505 may be irregular-shaped. The display screen 905 may be a liquid crystal display (LCD) screen, an organic light-emitting diode (OLED) screen, or the like.

The camera assembly 906 is configured to capture images or videos. In some embodiments, the camera assembly 906 includes a front camera and a rear camera. Usually, the front camera is disposed on the front panel of the terminal, and the rear camera is disposed on the back surface of the terminal. In some embodiments, at least two rear cameras are disposed, and each of the at least two rear cameras is at least one of a main camera, a depth-of-field camera, a wide-angle camera, and a telephoto camera, to realize a background blurring function achieved by fusion of the main camera and the depth-of-field camera, panoramic shooting and virtual reality (VR) shooting functions by fusion of the main camera and the wide-angle camera, or other fusion shooting functions. In some embodiments, the camera assembly 906 may also include a flashlight. The flashlight may be a mono-color temperature flashlight or a two-color temperature flashlight. The two-color temperature flashlight is a combination of a warm flashlight and a cold flashlight and is used for light compensation at different color temperatures.

The audio circuit 907 includes a microphone and a loudspeaker. The microphone is configured to acquire sound waves of users and the environments, and convert the sound waves to electrical signals which are input into the processor 901 for processing, or input into the radio frequency circuit 904 for voice communication. For stereophonic sound acquisition or noise reduction, there are a plurality of microphones disposed at different portions of the device 900 respectively. The microphone is an array microphone or an omnidirectional collection microphone. The loudspeaker is then configured to convert the electrical signals from the processor 901 or the radio frequency circuit 904 to the sound waves. The loudspeaker is a conventional film loudspeaker or a piezoelectric ceramic loudspeaker. In the case that the loudspeaker is the piezoelectric ceramic loudspeaker, the electrical signals may be converted into not only humanaudible sound waves but also the sound waves which are inaudible to humans for ranging and the like. In some embodiments, the audio circuit 907 further includes a headphone jack.

The positioning assembly 908 is configured to position a current geographical location of the device 900 to implement navigation or a location-based service (LBS). The positioning assembly 908 may be the United States' Global Positioning System (GPS), China's BeiDou Navigation Satellite System (BDS), Russia's Global Navigation Satellite System (GLONASS), and the European Union's Galileo Satellite Navigation System (Galileo).

The power source 909 is configured to supply power for various components in the device 900. The power source 909 is an alternating current, a direct current, a disposable battery, or a rechargeable battery. In the case that the power source 909 includes the rechargeable battery, the rechargeable battery may be a wired rechargeable battery or a wireless rechargeable battery. The wired rechargeable battery is a battery charged through a cable line, and the wireless rechargeable battery is a battery charged through a wireless coil. The rechargeable battery is further configured to support the fast charging technology.

In some embodiments, the device 900 further includes one or more sensors 910. The one or more sensors 910 include, but are not limited to, an acceleration sensor 911, a gyro sensor 912, a force sensor 913, a fingerprint sensor 914, an optical sensor 915, and a proximity sensor 916.

The acceleration sensor 911 may detect magnitudes of accelerations on three coordinate axes of a coordinate system established by the device 900. For example, the acceleration sensor 911 may be configured to detect components of a gravitational acceleration on the three coordinate axes. The processor 901 may control the display screen 905 to display a user interface in a landscape view or a portrait view based on a gravity acceleration signal acquired by the acceleration sensor 911. The acceleration sensor 911 may also be configured to acquire motion data of a game or a user.

The gyro sensor 912 detects a body direction and a rotation angle of the device 900 and cooperates with the acceleration sensor 911 to acquire a 3D motion of the user on the device 900. Based on the data acquired by the gyro sensor 912, the processor 901 achieves the following functions: motion sensing (such as changing the UI according to a user's tilt operation), image stabilization during shooting, game control, and inertial navigation.

The force sensor 913 is disposed on a side frame of the device 900 and/or a lower layer of the display screen 905. In the case that the force sensor 913 is disposed on the side frame of the device 900, a user's holding signal to the device 900 is detected. The processor 901 performs left-right hand recognition or quick operation according to the holding signal acquired by the force sensor 913. In the case that the force sensor 913 is disposed on the lower layer of the display screen 905, the processor 901 controls an operable control on the UI according to a user's pressure operation on the display screen 905. The operable control includes at least one of a button control, a scroll bar control, an icon control, and a menu control.

The fingerprint sensor 914 is configured to acquire a user's fingerprint. The processor 901 identifies the user's identity based on the fingerprint acquired by the fingerprint sensor 914, or the fingerprint sensor 914 identifies the user's identity based on the acquired fingerprint. In the case that the user's identity is identified as trusted, the processor 901 authorizes the user to perform related sensitive operations, such as unlocking the screen, viewing encrypted information, downloading software, paying, and changing settings. The fingerprint sensor 914 is disposed on the front, the back, or the side of the device 900. In the case that the device 900 is provided with a physical button or a manufacturer's logo, the fingerprint sensor 914 is integrated with the physical button or the manufacturer's logo.

The optical sensor 915 is configured to acquire ambient light intensity. In one embodiment, the processor 901 controls the display brightness of the display screen 905 based on the ambient light intensity acquired by the optical sensor 915. In some embodiments, in the case that the ambient light intensity is high, the display brightness of the display screen 905 is increased; and in the case that the ambient light intensity is low, the display brightness of the display screen 905 is decreased. In some embodiments, the processor 901 further dynamically adjusts shooting parameters of the camera assembly 906 based on the ambient light intensity acquired by the optical sensor 915.

The proximity sensor 916, also referred to as a distance sensor, is usually disposed on the front panel of the device 900. The proximity sensor 916 is configured to acquire a distance between the user and a front surface of the device 900. In some embodiments, in the case that the proximity sensor 916 detects that the distance between the user and the front surface of the device 900 gradually decreases, the processor 901 controls the display screen 905 to switch from a screen-on state to a screen-off state. In the case that the proximity sensor 916 detects that the distance between the user and the front surface of the device 900 gradually increases, the processor 901 controls the display screen 905 to switch from the screen-off state to the screen-on state.

Figure 10:
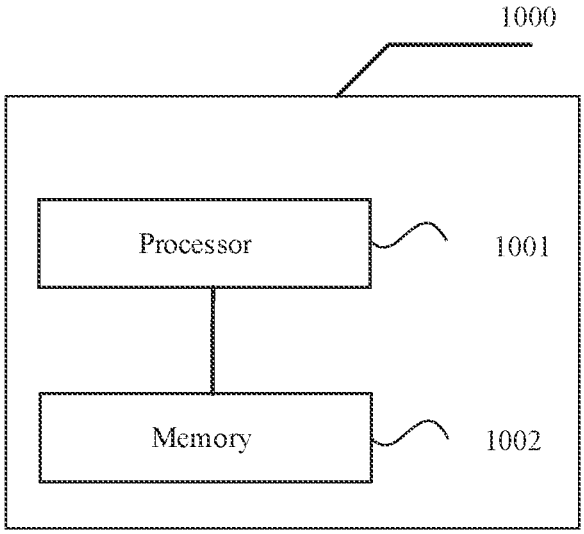
FIG. 10 is a block diagram of another electronic device according to an embodiment of the present disclosure.

FIG. 10 is a structural block diagram of an electronic device 1000 according to an embodiment of the present disclosure. The device 1000 is executed as a server. The server 1000 may have relatively large differences due to different configurations or performance, and includes one or more central processing units (CPU) 1001 and one or more memories 1002. In addition, the server also has components such as a wired or wireless network interface, a keyboard, an input and output interface for input and output, and the server further includes other components for implementing device functions, which will not be repeated here.

In summary, the electronic device is provided in the embodiments of the present disclosure. The electronic device includes a processor; and a memory configured to store one or more instructions executable by the processor; wherein the processor is configured to execute the one or more instructions to perform the method for processing the audio as described in the above embodiments.

An embodiment of the present disclosure further provides a non-volatile storage medium. The storage medium stores one or more instructions, such as a memory storing one or more instructions. The one or more instructions, when loaded and executed by the electronic device 900 or a processor of the electronic device 1000, cause the electronic device 900 or the electronic device 100 to perform the method for processing the audio as described in the above embodiments. In some embodiments, the storage medium is a non-transitory computer-readable storage medium. For example, the non-transitory computer-readable storage medium is a read-only memory (ROM), a random-access memory (RAM), a compact disc read-only memory (CD-ROM), a magnetic tape, a floppy disk, an optical data storage device, or the like.

An embodiment of the present disclosure further provides a computer program product. The computer program product stores one or more instructions therein. The one or more instructions, when loaded and executed by the electronic device 900 or a processor of the electronic device 1000, cause the electronic device 900 or the electronic device 1000 to perform the method for processing the audio as described in the above embodiments.

All the embodiments of the present disclosure may be practiced individually or in combination with other embodiments, which are all regarded as the scope of protection required by the present disclosure.

What is claimed is:

1. A method for processing audio, comprising:

acquiring an accompaniment audio signal and a vocal signal of a current to-be-processed musical composition;

determining a target reverberation intensity parameter value of the acquired accompaniment audio signal, wherein the target reverberation intensity parameter value is configured to indicate a rhythm speed, an accompaniment type, and a performance score of a singer of the current to-be-processed musical composition, wherein the accompaniment type is characterized by frequency domain richness of the current to-be-processed musical composition, wherein the frequency domain richness is numerically represented by a frequency domain richness coefficient, the richer the accompaniment of the current to-be-processed musical composition is, the higher the corresponding frequency domain richness is, the frequency domain richness coefficient being determined based on amplitude information of a sequence of accompaniment audio frames, and the sequence of accompaniment audio frame being acquired by transforming the accompaniment audio signal from a time domain to a time-frequency domain, and wherein the performance score of the singer is a history song score or a real-time song score of the singer; and reverberating the acquired vocal signal based on the target reverberation intensity parameter value.

2. The method according to claim 1, wherein said determining the target reverberation intensity parameter value of the acquired accompaniment audio signal comprises:

determining a first reverberation intensity parameter value of the acquired accompaniment audio signal, wherein the first reverberation intensity parameter value is configured to indicate the accompaniment type of the current to-be-processed musical composition;

determining a second reverberation intensity parameter value of the acquired accompaniment audio signal, wherein the second reverberation intensity parameter value is configured to indicate the rhythm speed of the current to-be-processed musical composition;

determining a third reverberation intensity parameter value of the acquired accompaniment audio signal, wherein the third reverberation intensity parameter value is configured to indicate the performance score of the singer of the current to-be-processed musical composition; and determining the target reverberation intensity parameter value based on the first reverberation intensity parameter value, the second reverberation intensity parameter value, and the third reverberation intensity parameter value.

3. The method according to claim 2, wherein said determining the first reverberation intensity parameter value of the acquired accompaniment audio signal comprises:

acquiring amplitude information of each of the accompaniment audio frames in the sequence of accompaniment audio frames;

determining a frequency domain richness coefficient of each of the accompaniment audio frames based on the amplitude information of each of the accompaniment audio frames, wherein the frequency domain richness coefficient is configured to indicate frequency domain richness of the amplitude information of each of the accompaniment audio frames; and determining the first reverberation intensity parameter value based on the frequency domain richness coefficient of each of the accompaniment audio frames.

4. The method according to claim 3, wherein said determining the first reverberation intensity parameter value based on the frequency domain richness coefficient of each of the accompaniment audio frames comprises:

determining a global frequency domain richness coefficient of the current to-be-processed musical composition based on the frequency domain richness coefficient of each of the accompaniment audio frames; and acquiring a first ratio of the global frequency domain richness coefficient to a maximum frequency domain richness coefficient, and determining a minimum of the first ratio and a target value as the first reverberation intensity parameter value.

5. The method according to claim 3, wherein said determining the first reverberation intensity parameter value based on the frequency domain richness coefficient of each of the accompaniment audio frames comprises:

generating a waveform for indicating the frequency domain richness based on the frequency domain richness coefficient of each of the accompaniment audio frames;

smoothing the generated waveform, and determining frequency domain richness coefficients of different parts of the current to-be-processed musical composition based on the smoothed waveform;

acquiring a second ratio of the frequency domain richness coefficient of each of the different parts to a maximum frequency domain richness coefficient; and determining, for each acquired second ratio, a minimum of the second ratio and a target value as the first reverberation intensity parameter value.

6. The method according to claim 2, wherein said determining the second reverberation intensity parameter value of the acquired accompaniment audio signal comprises:

acquiring a number of beats of the acquired accompaniment audio signal within a specified duration;

acquiring a third ratio of the acquired number of beats to a maximum number of beats; and determining a minimum of the third ratio and a target value as the second reverberation intensity parameter value.

7. The method according to claim 2, wherein said determining the third reverberation intensity parameter value of the acquired accompaniment audio signal comprises:

acquiring an audio performance score of the singer of the current to-be-processed musical composition, and determining the third reverberation intensity parameter value based on the audio performance score.

8. The method according to claim 2, wherein said determining the target reverberation intensity parameter value based on the first reverberation intensity parameter value, the second reverberation intensity parameter value, and the third reverberation intensity parameter value comprises:

acquiring a basic reverberation intensity parameter value, a first weight value, a second weight value, and a third weight value;

determining a first sum value, wherein the first sum value is a product of the first weight value and the first reverberation intensity parameter value;

determining a second sum value, wherein the second sum value is a product of the second weight value and the second reverberation intensity parameter value;

determining a third sum value, wherein the third sum value is a product of the third weight value and the third reverberation intensity parameter value; and acquiring a fourth sum value, wherein the fourth sum value is a sum of the basic reverberation intensity parameter value, the first sum value, the second sum value, and the third sum value; and determining a minimum of the fourth sum value and a target value as the target reverberation intensity parameter value.

9. The method according to claim 1, wherein said reverberating the acquired vocal signal based on the target reverberation intensity parameter value comprises:

adjusting a total reverberation gain of the acquired vocal signal based on the target reverberation intensity parameter value; or adjusting at least one reverberation algorithm parameter of the acquired vocal signal based on the target reverberation intensity parameter value.

10. The method according to claim 1, wherein after reverberating the acquired vocal signal, the method further comprises:

mixing the acquired accompaniment audio signal and the reverberated vocal signal, and outputting the mixed audio signal.

11. An electronic device, comprising:

a processor; and a memory configured to store one or more instructions executable by the processor;

wherein the processor, when loading and executing the one or more instructions, is caused to perform:

acquiring an accompaniment audio signal and a vocal signal of a current to-be-processed musical composition;

determining a target reverberation intensity parameter value of the acquired accompaniment audio signal, wherein the target reverberation intensity parameter value is configured to indicate a rhythm speed, an accompaniment type, and a performance score of a singer of the current to-be-processed musical composition, wherein the accompaniment type is characterized by frequency domain richness of the current to-be-processed musical composition, wherein the frequency domain richness is numerically represented by a frequency domain richness coefficient, the richer the accompaniment of the current to-be-processed musical composition is, the higher the corresponding frequency domain richness is, the frequency domain richness coefficient being determined based on amplitude information of a sequence of accompaniment audio frames, and the sequence of accompaniment audio frame being acquired by transforming the accompaniment audio signal from a time domain to a time-frequency domain, and wherein the performance score of the singer is a history song score or a real-time song score of the singer; and reverberating the acquired vocal signal based on the target reverberation intensity parameter value.

12. The electronic device according to claim 11, wherein the processor, when loading and executing the one or more instructions, is caused to perform:

determining a first reverberation intensity parameter value of the acquired accompaniment audio signal, wherein the first reverberation intensity parameter value is configured to indicate the accompaniment type of the current to-be-processed musical composition;

determining a second reverberation intensity parameter value of the acquired accompaniment audio signal, wherein the second reverberation intensity parameter value is configured to indicate the rhythm speed of the current to-be-processed musical composition;

determining a third reverberation intensity parameter value of the acquired accompaniment audio signal, wherein the third reverberation intensity parameter value is configured to indicate the performance score of the singer of the current to-be-processed musical composition; and determining the target reverberation intensity parameter value based on the first reverberation intensity parameter value, the second reverberation intensity parameter value, and the third reverberation intensity parameter value.

13. The electronic device according to claim 12, wherein the processor, when loading and executing the one or more instructions, is caused to perform:

acquiring amplitude information of each of the accompaniment audio frames in the sequence of accompaniment audio frames;

determining a frequency domain richness coefficient of each of the accompaniment audio frames based on the amplitude information of each of the accompaniment audio frames, wherein the frequency domain richness coefficient is configured to indicate frequency domain richness of the amplitude information of each of the accompaniment audio frames; and determining the first reverberation intensity parameter value based on the frequency domain richness coefficient of each of the accompaniment audio frames.

14. The electronic device according to claim 13, wherein the processor, when loading and executing the one or more instructions, is caused to perform:

determining a global frequency domain richness coefficient of the current to-be-processed musical composition based on the frequency domain richness coefficient of each of the accompaniment audio frames; and acquiring a first ratio of the global frequency domain richness coefficient to a maximum frequency domain richness coefficient, and determining a minimum of the first ratio and a target value as the first reverberation intensity parameter value.

15. The electronic device according to claim 13, wherein the processor, when loading and executing the one or more instructions, is caused to perform:

generating a waveform for indicating the frequency domain richness based on the frequency domain richness coefficient of each of the accompaniment audio frames;

smoothing the generated waveform, and determining frequency domain richness coefficients of different parts of the current to-be-processed musical composition based on the smoothed waveform;

acquiring a second ratio of the frequency domain richness coefficient of each of the different parts to a maximum frequency domain richness coefficient; and determining, for each acquired second ratio, a minimum of the second ratio and a target value as the first reverberation intensity parameter value.

16. The electronic device according to claim 12, wherein the processor, when loading and executing the one or more instructions, is caused to perform:

acquiring a number of beats of the acquired accompaniment audio signal within a specified duration;

acquiring a third ratio of the acquired number of beats to a maximum number of beats; and determining a minimum of the third ratio and a target value as the second reverberation intensity parameter value.

17. The electronic device according to claim 12, wherein the processor, when loading and executing the one or more instructions, is caused to perform:

acquiring an audio performance score of the singer of the current to-be-processed musical composition, and determining the third reverberation intensity parameter value based on the audio performance score.

18. The electronic device according to claim 12, wherein the processor, when loading and executing the one or more instructions, is caused to perform:

acquiring a basic reverberation intensity parameter value, a first weight value, a second weight value, and a third weight value;

determining a first sum value, wherein the first sum value is a product of the first weight value and the first reverberation intensity parameter value;

determining a second sum value, wherein the second sum value is a product of the second weight value and the second reverberation intensity parameter value;

determining a third sum value, wherein the third sum value is a product of the third weight value and the third reverberation intensity parameter value; and calculating a fourth sum value, wherein the fourth sum value is a sum of the basic reverberation intensity parameter value, the first sum value, the second sum value, and the third sum value; and determining a minimum of the fourth sum value and a target value as the target reverberation intensity parameter value.

19. The electronic device according to claim 11, wherein the processor, when loading and executing the one or more instructions, is caused to perform:

adjusting a total reverberation gain of the acquired vocal signal based on the target reverberation intensity parameter value; or adjusting at least one reverberation algorithm parameter of the acquired vocal signal based on the target reverberation intensity parameter value.

20. A non-volatile storage medium storing one or more instructions therein, wherein the one or more instructions, when loaded and executed by a processor of an electronic device, cause the electronic device to perform:

acquiring an accompaniment audio signal and a vocal signal of current to-be-processed musical composition;

determining a target reverberation intensity parameter value of the acquired accompaniment audio signal, wherein the target reverberation intensity parameter value is configured to indicate a rhythm speed, an accompaniment type, and a performance score of a singer of the current to-be-processed musical composition, wherein the accompaniment type is characterized by frequency domain richness of the current to-be-processed musical composition, wherein the frequency domain richness is numerically represented by a frequency domain richness coefficient, the richer the accompaniment of the current to-be-processed musical composition is, the higher the corresponding frequency domain richness is, frequency domain richness coefficient is determined based on amplitude information of a sequence of accompaniment audio frames, and the sequence of accompaniment audio frame is acquired by transforming the accompaniment audio signal from a time domain to a time-frequency domain, and wherein the performance score of the singer is a history song score or a real-time song score of the singer; and reverberating the acquired vocal signal based on the target reverberation intensity parameter value.

* * * * *